US009338536B2

(12) United States Patent
Barksdale et al.

(10) Patent No.: US 9,338,536 B2
(45) Date of Patent: May 10, 2016

(54) MODULAR HEADREST-BASED AUDIO SYSTEM

(71) Applicant: Bose Corporation, Framingham, MA (US)

(72) Inventors: Tobe Z. Barksdale, Bolton, MA (US); Michael S. Dublin, Arlington, MA (US); Charles Oswald, Arlington, MA (US)

(73) Assignee: Bose Corporation, Framingham, MA (US)

( * ) Notice: Subject to any disclaimer, the term of this patent is extended or adjusted under 35 U.S.C. 154(b) by 303 days.

(21) Appl. No.: 13/888,932

(22) Filed: May 7, 2013

(65) Prior Publication Data

US 2014/0334638 A1 Nov. 13, 2014

(51) Int. Cl.

| | |
|---|---|
| ***H04R 5/02*** | (2006.01) |
| ***H04R 1/02*** | (2006.01) |
| ***H04R 3/12*** | (2006.01) |
| *H04R 5/04* | (2006.01) |

(52) U.S. Cl.

CPC ..... *H04R 1/025* (2013.01); *H04R 3/12* (2013.01); *H04R 5/023* (2013.01); *H04R 5/04* (2013.01); *H04R 2499/13* (2013.01)

(58) Field of Classification Search

CPC ..... H04R 2499/13; H04R 1/02; H04R 1/028; H04R 1/025; H04R 3/00; H04R 3/12; H04R 5/02; H04R 5/023; H04R 2420/07; H04R 2420/01; H04R 2430/01; G10K 15/02; G10K 15/04; G10K 11/22; G10K 11/0217; B60R 11/02; B60R 11/0247; B60R 2011/0017; H04S 7/303; H04S 7/30; H04S 7/302; H04S 2400/11; H04S 2420/01; H04S 5/00; H04S 5/02; H04S 7/307; H04S 2400/01; H04S 3/00; H04S 3/002; H04S 2400/05; H04S 2400/07; H04S 1/00; H04S 1/007; G10L 19/008; G10L 21/0364; G10L 15/142; H04N 21/43615; H04N 21/439

USPC ..... 381/86, 302, 1, 2, 7, 10, 11, 17, 18, 19, 381/22, 23, 300, 303–308, 310, 311, 27, 28, 381/61, 77, 78, 80, 81, 85, 89, 332, 111, 381/116, 117; 340/692, 327, 384.73, 392.1, 340/392.4, 404.1

See application file for complete search history.

(56) References Cited

U.S. PATENT DOCUMENTS

| | | | | |
|---|---|---|---|---|
| 6,217,118 | B1 | 4/2001 | Heilig | |
| 7,466,832 | B2 | 12/2008 | House | |
| 2003/0142842 | A1 * | 7/2003 | Arai et al. | 381/300 |
| 2007/0133949 | A1 | 6/2007 | Tatsuta et al. | |
| 2008/0292106 | A1 * | 11/2008 | Nakagaki | 381/1 |
| 2010/0148550 | A1 | 6/2010 | Kidd | |

FOREIGN PATENT DOCUMENTS

| | | | | |
|---|---|---|---|---|
| EP | 1536664 | A2 | 6/2005 | |
| EP | 2405670 | A1 | 1/2012 | |
| GB | 2310577 | A * | 8/1997 | H04R 5/04 |
| JP | 2005212653 | A | 8/2005 | |
| JP | 2008206655 | A | 9/2008 | |
| WO | 2009/012500 | A2 | 1/2009 | |
| WO | 2012172394 | A1 | 12/2012 | |
| WO | WO 2012172394 | A1 * | 12/2012 | H04S 3/00 |

OTHER PUBLICATIONS

International Search Report and Written Opinion dated Jul. 23, 2014 for International application No. PCT/US2014/035597.

* cited by examiner

*Primary Examiner* — Leshui Zhang
(74) *Attorney, Agent, or Firm* — Bose Corporation

(57) ABSTRACT

An automobile audio system includes a signal processor configured to receive and process audio signals from a source and provide processed audio signals to an amplifier, a first headrest including a headrest speaker and coupled to a driver's seat, a first fixed speaker positioned near a left corner of the vehicle's cabin forward of the headrest, a second fixed speaker positioned near a right corner of the vehicle's cabin forward of the headrest, and a headrest accessory port located in a passenger's seat. The port is configured to connect the audio system to a second headrest speaker. The processor uses a first set of parameters for processing the received audio signals when the first headrest speaker is connected and the second headrest speaker is not connected, and a second set of parameters for processing the received audio signals when both the first and second headrest speaker are connected.

15 Claims, 3 Drawing Sheets

MODULAR HEADREST-BASED AUDIO SYSTEM

BACKGROUND

This disclosure relates to a modular headrest-based audio system.

In some automobile audio systems, processing is applied to the audio signals provided to each speaker based on the electrical and acoustic response of the total system, that is, the responses of the speakers themselves and the response of the vehicle cabin to the sounds produced by the speakers. Such a system is highly individualized to a particular automobile model and trim level, taking into account the location of each speaker and the absorptive and reflective properties of the seats, glass, and other components of the car, among other things. Such a system is generally designed as part of the product development process of the vehicle and corresponding equalization and other audio system parameters are loaded into the audio system at the time of manufacture or assembly.

SUMMARY

A modular headrest-based audio system for a passenger car includes a set of speakers fixed in the vehicle cabin, and speakers located in only one of the car's headrests. A first set of audio system parameters are used to adjust the audio signals provided to the various speakers, delivering an audio experience focused around the one seat having speakers in its headrest. When an optional second headrest is installed, bringing speakers to the headrest of the second seat, the audio system parameters are changed, not just for the new headrest, but also for the fixed speakers and in some cases the first headrest, making the best use of the added speakers. An optional bass-box can also be added, again changing the audio system parameters not just for the added component, but also for the fixed speakers to provide a total system performance improvement.

In general, in one aspect, an automobile audio system includes a signal processor configured to receive and process audio signals from a source and provide processed audio signals to an amplifier, a first headrest including a headrest speaker and coupled to a driver's seat, a first fixed speaker positioned near a left corner of the vehicle's cabin forward of the headrest, a second fixed speaker positioned near a right corner of the vehicle's cabin forward of the headrest, and a headrest accessory port located in a passenger's seat. The headrest accessory port is configured to connect the audio system to a second headrest speaker in a second headrest. The signal processor uses a first set of processing parameters for processing the received audio signals when the first headrest speaker is connected to the audio system and the second headrest speaker is not connected to the audio system, and the signal processor uses a second set of processing parameters for processing the received audio signals when both the first headrest speaker and the second headrest speaker are connected to the audio system.

Implementations may include one or more of the following, in any combination. The processed audio signals provided to the amplifier for each of the first fixed speaker and the second fixed speaker using the first set of processing parameters may be different from the processed audio signals provided for the first fixed speaker and the second fixed speaker using the second set of processing parameters. The processed audio signals provided to the amplifier for the first headrest speaker using the first set of processing parameters may be different from the processed audio signals provided for the first headrest speaker using the second set of processing parameters. The processed audio signals provided to the amplifier for the first headrest speaker using the second set of processing parameters may be different from the processed audio signals provided for the second headrest speaker using the second set of processing parameters. The signal processor may remix the audio signals from the source into intermediate signals corresponding to a set of component directions, and each of the first and second set of processing parameters may distribute different portions of the intermediate signals corresponding to each of the component directions to the headrest speaker and the first and second fixed speakers.

The system may not include fixed speakers in the vehicle cabin located rearward of the first headrest. The processed audio signals provided to the amplifier may minimize leakage of sound from the driver's seat to the passenger's seat. The first headrest speaker may include at least two electroacoustic transducers, at least one located at either end of the headrest. The processed audio signals provided to the amplifier for the first headrest speaker may control cross-talk of signals between each one of the electroacoustic transducers and an ear of the listener positioned near a different one of the electroacoustic transducers. The first headrest speaker may include a pair of arrays of electroacoustic transducers located at either end of the headrest. The first headrest speaker may include an array of electroacoustic transducers located inside the headrest. A bass unit accessory port may be configured to connect the audio system to a bass unit, wherein the signal processor may use a third set of processing parameters for processing the received audio signals when a bass unit may be connected to the audio system. The processed audio signals provided to the amplifier for each of the first fixed speaker and the second fixed speaker using the third set of processing parameters may be different from the processed audio signals provided for the first fixed speaker and the second fixed speaker using either the first or the second set of processing parameters. The processed audio signals provided to the amplifier for the first headrest speaker using the third set of processing parameters may be different from the processed audio signals provided for the first headrest speaker using either the first or the second set of processing parameters.

Advantages include providing a cost-effective solution for delivering a high-quality audio experience in a small car, which expands if needed to provide the same high-quality sound for a passenger that the driver experiences, and to increase the bass response of the system if desired.

All examples and features mentioned above can be combined in any technically possible way. Other features and advantages will be apparent from the description and the claims.

DESCRIPTION

Figure 1:
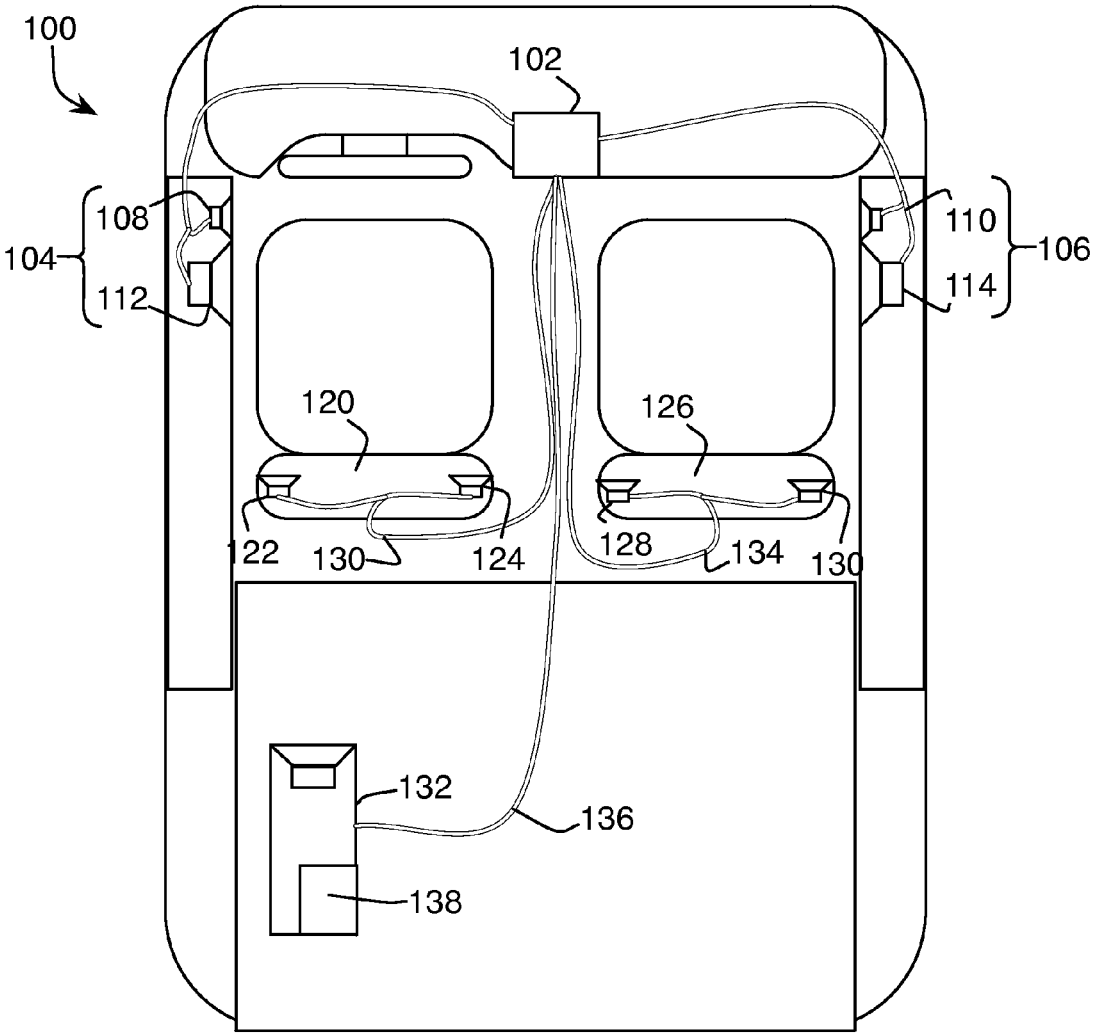
FIG. 1 shows a schematic diagram of a modular headrest-based audio system in an automobile.

Conventional car audio systems are based around a set of four or more speakers, two on the instrument panel or in the front doors and two generally located on the rear package shelf, in sedans and coupes, or in the rear doors or walls in wagons and hatchbacks. In some cars, such as small cars, however, as shown in FIG. 1, speakers may be provided in the headrest rather than in the traditional locations behind the driver. This saves space in the rear of the car, and doesn't waste energy providing sound to a back seat that, if even present, is unlikely to be used for passengers. The audio system 100 shown in FIG. 1 includes a combined source/processing/amplifying unit 102. In some examples, the different functions may be divided between multiple components. In particular, the source is often separated from the amplifier, and the processing provided by either the source or the amplifier, though the processing may also be provided by a separate component. The processing may also be provided by software loaded onto a general purpose computer providing functions of the source and/or the amplifier. We refer to signal processing and amplification provided by "the system" generally, without specifying any particular system architecture or technology.

The audio system shown in FIG. 1 has two sets of speakers 104, 106 permanently attached to the vehicle structure. We refer to these as "fixed" speakers. In the example of FIG. 1, each set of fixed speakers includes two speakers, a tweeter 108, 110, and a low-to-mid range speaker 112, 114. The two speakers in each set may be driven by a single amplified signal from the amplifier, with a passive crossover network (which may be embedded in one or both speakers) distributing signals in different frequency ranges to the appropriate speakers. Alternatively, the amplifier may provide a band-limited signal directly to each speaker. In other examples, full range speakers are used, and in still other examples, more than two speakers are used per set. Each individual speaker shown may also be implemented as an array of speakers, which may allow more sophisticated shaping of the sound, or simply a more economical use of space and materials to deliver a given sound pressure level.

The driver's headrest 120 in FIG. 1 includes two speakers 122, 124, which again are shown abstractly and may in fact each be arrays of speakers. The speakers (whether individual speakers or arrays) may be operated cooperatively as an array themselves to control the distribution of sound to the listener's ears. The two speakers may be located at either end of the headrest, roughly corresponding to the expected separation of the driver's ears, leaving space in between for the cushion of the headrest, which is of course its primary function. In some examples, the speakers are located closer together at the rear of the headrest, with the sound delivered to the front of the headrest through an enclosure surrounding the cushion. The speakers may be oriented relative to each other and to the headrest components in a variety of ways, depending on the mechanical demands of the headrest and the acoustic goals of the system. Co-pending application 13/799,703, incorporated here by reference, describes several designs for packaging the speakers in the headrest without compromising the safety features of the headrest. The speakers of the headrest are shown in FIG. 1 as connected to the source 102 by cabling 130 going through the seat, though they may also communicate with the source 102 wirelessly, with the cabling providing only power. In some examples, the speakers 122 and 124 may be located in other places than directly in the headrest, such as in the seatback, especially in seats where the headrest is an integrated part of the seatback, or in the headliner or a roll-bar.

A small-car audio system may be designed in part to optimize the experience of the driver, and not provide speakers in the passenger headrest. A passenger headrest 126 with additional speakers 128 and 130 and a rear-mounted bass box 132 may be offered as options to a buyer who does want to provide sound for the passenger or sacrifice valuable storage space for increased audio performance. When such optional speakers are installed, the tuning of the entire audio system is adjusted to make the best use of the added speakers.

Cabling 134 may be present in the passenger seat, to simplify the task of adding the optional second headrest 126 to that seat after the vehicle is manufactured, or it may be added as needed by the dealer at the time a second headrest is purchased. If the headrest 126 is wireless, cabling 134 may only provide power to the headrest, and may already be present in the seat for other powered functions, such as positioning motors and heaters. The optional bass box 132 is located in the cargo area of the vehicle, connected to the source 102 by cabling 136, which again may be original equipment or may be dealer-installed. In some examples, the bass box 132 has a built-in amplifier 138, so that the source 102 need only provide an equalized, but not amplified, audio signal to the bass box.

A large set of adjustable parameters affect the performance of an audio system, and we refer to one set of such parameters, configured to provide a desired experience in a given audio system, as a "tuning." A tuning may include values for such parameters as the gain applied to each audio signal, phase adjustments to different audio signals to control the phase alignment of the sounds produced by different speakers, filters applied to shape the sound, and so forth. In particular, for systems including headrest speakers, complex filters may be used to control the binaural perception of sound at the head, and to avoid or control cross-talk between signals reaching the ears of each listener, and between the seats themselves.

In some examples, the audio source provides only two channels, i.e., left and right stereo audio. Two other common options are four channels, i.e., left and right for both front and rear, and five channels for surround sound sources. Four channels are normally found when a standard automotive head unit is used, in which case the two front and two rear channels will usually have the same content, but may be at different levels due to "fader" settings in the head unit. To properly mix sounds for a system as described herein, the two or more channels of audio are up-mixed into an intermediate number of components corresponding to different directions from which the sound may appear to come, and then re-mixed into output channels meant for each specific speaker in the system. One example of such up-mixing and re-mixing is described in U.S. Pat. No. 7,630,500, incorporated here by reference. We use "component" to refer to each of the intermediate directional assignments to which the original source material is up-mixed. A portion of each component is mixed into each output channel (though that portion may approach zero for some component-output channel combinations). For example, the audio signal for a "right front" component will be mostly distributed to the right fixed speaker, with some portion of it also distributed to the right headrest speaker. The audio signal for a "center front" component will be evenly distributed to the right and left fixed speakers, with some portion of it also distributed to the right and left headrest speakers, which helps to focus the location from which the listener perceives the center component to originate. The particular distribution of component content to the output channels will vary based on how many and which headrest speakers are installed. An example of this mixing and the signal processing behind it is described in co-pending application Ser. No. 13,888,927, incorporated here by reference.

One aspect of the audio experience that is controlled by the tuning of the car is the sound stage. "Sound stage" refers to the listener's perception of where the sound is coming from. In particular, it is generally desired that a sound stage be wide (sound comes from both sides of the listener), deep (sound comes from both near and far), and precise (the listener can identify where a particular sound appears to be coming from).

In an ideal system, someone listening to recorded music can close their eyes, imagine that they are at a live performance, and point out where each musician is located. A related concept is "envelopment," by which we refer to the perception that sound is coming from all directions, including from behind the listener, independently of whether the sound is precisely localizable. Perception of sound stage and envelopment (and sound location generally) is based on level and arrival-time (phase) differences between sounds arriving at both of a listener's ears, soundstage can be controlled by manipulating the audio signals produced by the speakers to control these inter-aural level and time differences. As described in U.S. Pat. No. 8,325,936, incorporated here by reference, not only the headrest-based speakers but also the fixed speakers may be used cooperatively to control spatial perception.

If a headrest-based system is used alone, the sound will be perceived as coming from behind the listener, since that is indeed where the speakers are. However, when properly combined with speakers in front of the driver, such as in the traditional fixed locations on the instrument panel or in the doors, the speakers in the headrest can be used to improve the staging of the sound coming from the front speakers. That is, rather than simply replacing the rear-seat speakers to provide "rear" sound, the headrest is used to focus and control the listener's perception of the sound coming from the front of the car. This can provide a wider or deeper, and more controlled, sound stage than the front speakers alone could provide.

Figure 2A:
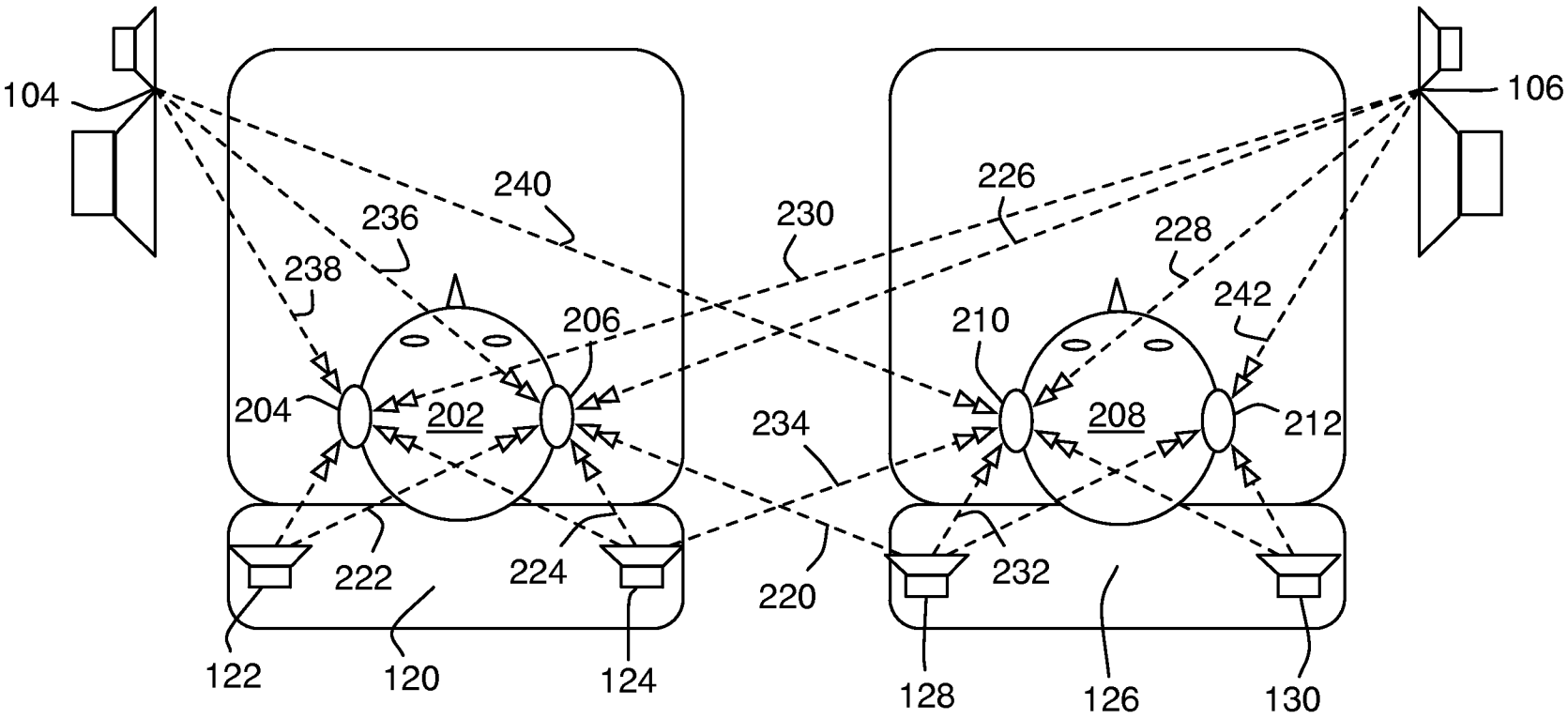
FIGS. 2A through 2D show schematic representations of signal paths from speakers to the ears of listeners.
Figure 2B:
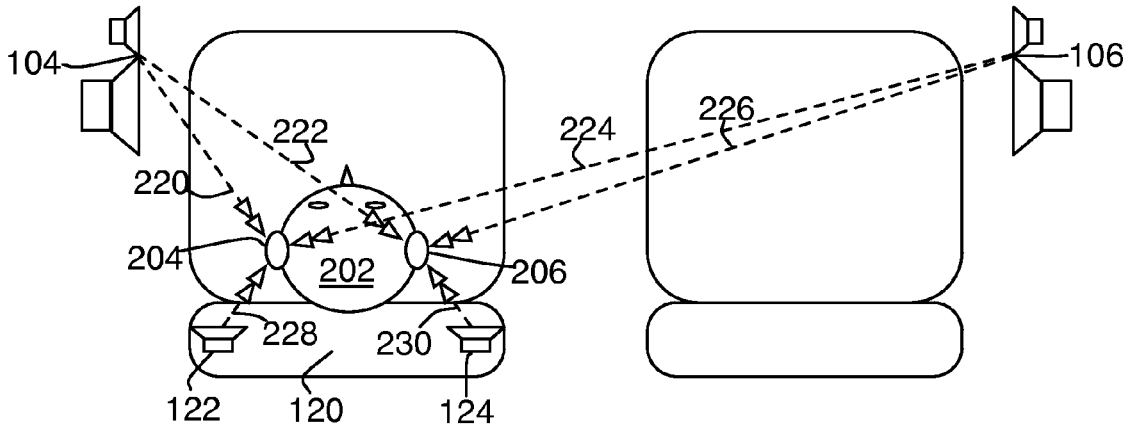
Figure 2C:
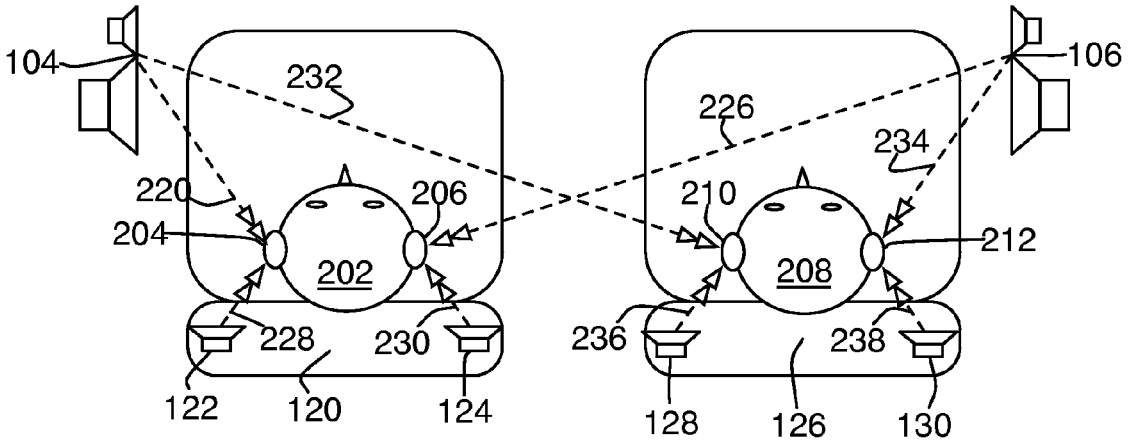
Figure 2D:
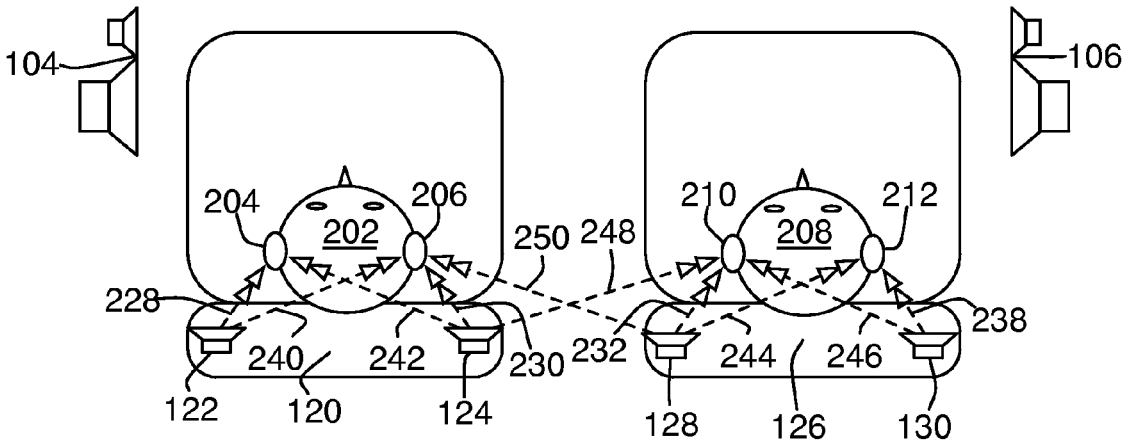

To use the headrest speaker to enhance the soundstage of the front fixed speakers, a tuning provides specific adjustments to the signals going to each of the speakers. The tuning of both the fixed speakers 104, 106 and of the headrest speakers 122, 124, 128, 130 will be different for a system using one headrest than for a system using two headrests. A single headrest system will also be different from an otherwise identical system with the one headrest on the other side of the car (at a minimum, the parameters used for the let and right signals will be reversed). FIGS. 2A through 2D are used to illustrate these adjustments—they show two listener's heads as they are expected to be located relative to the speakers from FIG. 1. Driver 202 has a left ear 204 and right ear 206, and passenger 208's ears are labeled 210 and 212. Dashed arrows show various paths sound takes from the speakers to the listeners' ears as described below. FIG. 2A shows all the paths at once, while FIGS. 2B through 2D show subsets of the paths relevant to the various specific aspects of the system tuning. We refer to these arrows as "signals" or "paths," though in actual practice, we are not assuming that the speakers can control the direction of the sound they radiate, though that may be possible. The signals assigned to each speaker are superimposed to create the ultimate output signal, and all the energy from each speaker may travel omnidirectionally. The arrows merely show conceptually the different combinations of speaker and ear for easy reference. If arrays or other directional speaker technology is used, the signals may be provided to different combinations of speakers to provide some directional control.

FIG. 2B shows the distribution of sounds when only the driver's headrest is installed. Signals 220, 222, 224, and 226 from each fixed speaker arrive at both ears of the driver. For each individual fixed speaker, the slight time delay in the signals reaching the opposite ear (222 and 224), relative to the same signals reaching the close ear (220 and 226), will result in the driver localizing the sound to the correct side. The phase of the signals sent to the fixed speakers is modified to make sure that signals from the right fixed speaker 106 reach the right ear at the same time that corresponding signals from the left fixed speaker 104 reach the left ear. Thus, signals from both sides with the same content will be perceived at both ears simultaneously, and be perceived as coming from the center.

The signals from the center component are also sent to the headrest speakers. Each of the headrest speakers is assumed, for now, to only be heard by the corresponding ear, 228 and 230. By providing signals at both ears a controlled amount of time (i.e., by manipulating phase) before or after the signals from the fixed speakers, the headrest speakers can be used to control whether the driver perceives center component sounds as being very focused ahead of the driver, or more diffuse around the driver.

Signals corresponding to each of the right and left components of the up-mixed audio signals are also sent to both the fixed speakers and the headrest speakers. As is clear from the figure, as in any vehicle with side-by-side seating, the left fixed speaker is significantly closer to the driver than the right fixed speaker. Without the headrest speakers, this can result in the soundstage feeling very lopsided—sounds from the right are far away to the right, while sounds from the left are near at hand. This can be improved by providing portions of the left and right components differently at the left and right headrest speakers. The left headrest speaker 122 is used to pull the sound image from the left fixed speaker 104 farther back, which will be perceived as being farther to the left, outside the actual boundary of the car, while the right headrest speaker 124 is used to pull the sound image from the right fixed speaker 106 inward.

When the passenger's headrest 126 is added, as in FIG. 2C, the same problems exist for the passenger seat, but flipped left-to-right. The left fixed speaker 104 is heard at both listeners' left ears, 220 and 232, and the right fixed speaker 106 is heard at both listeners' right ears 226 and 234. The opposite-ear paths from the fixed speakers aren't shown, as they can be ignored as explained above. The processing that is applied to right side component signals going to the right speaker on the driver's headrest, for path 230, is now applied to left side component signals going to the left side speaker on the passenger's headrest, 236, and vice versa (i.e., left component processing for path 228 is applied to right component processing for path 238). Thus, the processing is reversed, while the component signals go to the same side in both headrests.

As opposed to the headrest signals, the phase adjustments made to signals going to the right fixed speaker 106 to balance the soundstage at the driver are not likely to be perceived in the same way by the passenger. Since it is now assumed that two listeners are present, the phase of the signals going to the fixed speakers will be adjusted to provide the best balance obtainable at both seats. This may compromise the single-seat performance, e.g., by making a center image less precise, but it improves the overall sound system perception when both positions are considered.

Another aspect of the tuning that will vary between the different configurations is cross-talk cancellation, as shown in FIG. 2D. Cross-talk cancellation is used to prevent sound meant for one ear from reaching another ear, by providing a sound signal at the second ear that matches but is out of phase with the signal meant for the first ear, resulting in destructive interference with the unwanted signal (i.e., cancellation). Within one headrest, cross-talk cancellation is provided between the left and right speakers. The two speakers in the headrest are used as an array, by providing a signal from the right speaker 124 that has the same content as the signal from the left speaker 122, but will be out of phase with that signal at the driver's right ear. Thus, signal 230 is used not only to deliver right-side component content to the right ear, but also to cancel left-side component content 240 from the left headrest speaker 122 at the right ear 206. Likewise, the signal 228 is used to cancel right-side component content 242 from the right headrest speaker 124 at the left ear 204.

When the second headrest 126 is present, the right speaker 124 of the driver's headrest is near the passenger's left ear. This may result in signals 248 from the right speaker (for either content or for cross-talk cancellation from the left speaker 122) being audible at the passenger's left ear 210, which would not be desirable. Likewise, signals 250 from the passenger's left speaker 128 may be audible at the driver's right ear 206. To avoid this, the level of direct signal and of cross-talk cancellation provided by the inboard speakers (driver's right speaker 124 and passenger's left speaker 128) may be reduced. This compromises the quality of the control over the sound stage and of cross-talk cancellation the headrests can provide, but avoids an unpleasant leakage of signals across seats.

If the system is capable, some additional processing is possible. As just mentioned, there are signals from each headrest leaking to the opposite seating position. Instead of decreasing the output of the inboard speakers to avoid this leakage, the speakers of each headrest can be used in combination to cancel their own sound in the direction of the opposite head, i.e., speakers 122 and 124 are used to cancel path 248, and speakers 128 and 130 are used to cancel path 250. One approach to make such control more feasible is to use arrays of transducers for each of the headrest speaker positions.

In some examples, the audio system is pre-configured with at least two tunings, for one headrest and for two. The system may also be configured with left and right single-headrest tunings. When only one headrest is installed, the appropriate single-headrest tuning is used. When a second headrest is added, the system changes to the two-headrest tuning. The change may be made automatically, in the case that the audio system is pre-wired for both headrests and therefore able to detect the installation of the second headrest, or the change may be made upon instruction from the technician or user installing the second headrest. Detecting the presence of the headrest may be done using an additional pin added to the connector (relative to what would be done for always-present equipment), by periodically polling the impedance on the cable to see if speakers have been attached, or through a wireless transceiver also used to provide signals to the headrest.

The tuning of the fixed front speakers will also depend on whether or not the optional bass module is installed. In addition to re-balancing the distribution of low-frequency content from the front speakers to the bass box, when it is available, the total level and phase of all the signals provided to the front speakers will be changed to control the perceived balance of the system across the full audible spectrum. For example, when higher bass frequency levels are available due to the presence of the bass box, the mid- and high-frequency sounds may also be played louder that they would have been when only the front speakers were used to provide the low-frequency sounds. This is because increasing the level of the bass while keeping the other frequencies the same will actually result in the higher frequencies sounding quieter, conversely, when high levels of bass were not available, the mid- and high-frequency sounds may have been suppressed to avoid the system sounding tinny or bright. In some examples, a phase alignment of all the speakers in the system is determined with the bass box installed, and that phase alignment is used in both modes—with and without the bass box. What is changed based on the presence or absence of the bass box is the level and component mix of the sounds going to the output channels.

As with the second headrest, the audio system may be pre-configured with two tunings (multiplied by the number of headrest tuning sets), for use with and without the bass box, and the appropriate tuning is loaded in the same manner. In the case of an optional bass box, even more than in the case of an optional headrest, it is likely that a customer may choose to remove and later reinstall the bass box at various times, such as to make more space available when transporting a full load of luggage. For this reason, it is advantageous that the system automatically detect the presence or absence of the bass box and automatically load the appropriate tuning.

Embodiments of the systems and methods described above may comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An automobile audio system comprising:

a signal processor configured to receive and process audio signals from a source and provide processed audio signals to an amplifier, a first headrest comprising a first headrest speaker connected to the automobile audio system and coupled to a driver's seat, a first fixed speaker positioned near a left corner of the vehicle's cabin forward of the first headrest, a second fixed speaker positioned near a right corner of the vehicle's cabin forward of the first headrest, and a headrest accessory port located in a passenger's seat, the headrest accessory port configured to receive a connector of a second headrest speaker in a second headrest and connect the automobile audio system to the second headrest speaker when the connector is received by the headrest accessory port, wherein the automobile audio system is configured to detect whether the second headrest speaker is connected to the automobile audio system, and wherein the signal processor uses a first set of processing parameters for processing the received audio signals when the first headrest speaker is connected to the automobile audio system and the second headrest speaker is not detected as being connected to the automobile audio system, and the signal processor uses a second set of processing parameters for processing the received audio signals when the first headrest speaker is connected to the automobile audio system and the second headrest speaker is detected as being connected to the automobile audio system.

2. The automobile audio system of claim 1, wherein the processed audio signals provided to the amplifier for each of the first fixed speaker and the second fixed speaker using the first set of processing parameters are different from the processed audio signals provided for the first fixed speaker and the second fixed speaker using the second set of processing parameters.

3. The automobile audio system of claim 1, wherein the processed audio signals provided to the amplifier for the first headrest speaker using the first set of processing parameters are different from the processed audio signals provided for the first headrest speaker using the second set of processing parameters.

4. The automobile audio system of claim 1, wherein the processed audio signals provided to the amplifier for the first headrest speaker using the second set of processing parameters are different from the processed audio signals provided for the second headrest speaker using the second set of processing parameters.

5. The automobile audio system of claim 1, wherein the signal processor remixes the audio signals from the source into intermediate signals corresponding to a set of component directions, and each of the first and second set of processing parameters distributes different portions of the intermediate signals corresponding to each of the component directions to the first headrest speaker and the first and second fixed speakers.

6. The automobile audio system of claim 1, wherein the automobile audio system does not include fixed speakers in the vehicle cabin located rearward of the first headrest.

7. The automobile audio system of claim 1, wherein the processed audio signals provided to the amplifier minimize leakage of sound from the driver's seat to the passenger's seat.

8. The automobile audio system of claim 1, wherein the first headrest speaker comprises at least two electroacoustic transducers, at least one located at either end of the first headrest.

9. The automobile audio system of claim 8, wherein the processed audio signals provided to the amplifier for the first headrest speaker control cross-talk of signals between each one of the at least two electroacoustic transducers and an ear of the listener positioned near a different one of the at least two electroacoustic transducers.

10. The automobile audio system of claim 1, wherein the first headrest speaker comprises a pair of arrays of electroacoustic transducers located at either end of the first headrest.

11. The automobile audio system of claim 1, wherein the first headrest speaker comprises an array of electroacoustic transducers located inside the first headrest.

12. The automobile audio system of claim 1, further comprising a bass unit accessory port configured to connect the automobile audio system to a bass unit, wherein the signal processor uses a third set of processing parameters for processing the received audio signals when a bass unit is connected to the automobile audio system.

13. The automobile audio system of claim 12, wherein the processed audio signals provided to the amplifier for each of the first fixed speaker and the second fixed speaker using the third set of processing parameters are different from the processed audio signals provided for the first fixed speaker and the second fixed speaker using either the first or the second set of processing parameters.

14. The automobile audio system of claim 12, wherein the processed audio signals provided to the amplifier for the first headrest speaker using the third set of processing parameters are different from the processed audio signals provided for the first headrest speaker using either the first or the second set of processing parameters.

15. The automobile audio system of claim 1, wherein the automobile audio system is configured to detect whether the second headrest speaker is connected by periodically polling an impedance of cabling that is coupled at one end to the headrest accessory port located in the passenger's seat.

* * * * *